US006290544B1

(12) United States Patent
Gong et al.

(10) Patent No.: US 6,290,544 B1
(45) Date of Patent: Sep. 18, 2001

(54) ELECTRICAL CONNECTOR WITH ADAPTER FOR INCREASING AN OVERALL HEIGHT OF THE CONNECTOR ABOVE A PRITED CIRCUIT BORAD

(75) Inventors: Liang Gong; Qisheng Zheng, both of Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/517,755

(22) Filed: Mar. 2, 2000

(30) Foreign Application Priority Data

Feb. 17, 2000 (TW) ..... 88221564

(51) Int. Cl.[7] ..... H01R 27/00
(52) U.S. Cl. ..... 439/651; 439/79
(58) Field of Search ..... 439/651, 79

(56) References Cited

U.S. PATENT DOCUMENTS 4,125,313 * 11/1978 Sipp et al. ..... 439/651
4,846,733 * 7/1989 Baisz et al. ..... 439/651
5,667,389 * 9/1997 Kidd et al. ..... 439/651
6,089,918 * 7/2000 Arakelian et al. ..... 439/651

* cited by examiner

*Primary Examiner*—Gary F. Paumen
(74) *Attorney, Agent, or Firm*—Wei Te Chung

(57) ABSTRACT

An electrical connector comprises a connector body retaining a plurality of terminals and an adapter retaining a like number of connecting contacts. Each terminal includes a contacting portions extending beyond a bottom surface thereof. Each connecting contact includes a main body to be received within the base, a tail portion extending downwards thereof for electrically connecting to the printed circuit board and a first portion and a second portion extending sidewards and upwards from the main body. The second portion, therefore, is laterally offset from the first portion. Both the first and second portions have, respectively, opposed first and second barbs extending inward from a side edge for clamping a contacting portion of corresponding terminal therebetween. Each contacting portion further defines a notch in a side edge thereof for engaging with the first barb of corresponding connecting contact.

1 Claim, 8 Drawing Sheets

ELECTRICAL CONNECTOR WITH ADAPTER FOR INCREASING AN OVERALL HEIGHT OF THE CONNECTOR ABOVE A PRITED CIRCUIT BORAD

BACKGROUND OF THE INVENTION

The present invention relates to an electrical connector, and particularly to an electrical connector having an adapter for increasing an overall height of the electrical connector above a printed circuit board (PCB) on which the connector is mounted, wherein the adapter can achieve a reliably electrical connection between the connector and the printed circuit board.

With the development of the multimedia computer, electrical connectors are widely used. Taiwan Patent Application Nos. 82207507; 84215349; 85206217; 85218465 and 86201643 each disclose a conventional electrical connector comprising a connector body and a plurality of terminals received in the connector body. A tubular receptacle extends from a front surface of the connector body for engaging with a plug. Generally, the conventional electrical connector has a fixed height. To use it in an application needing the connector to increase its height, the connector body and the terminals thereof must be changed resulting in that the mold used for forming the connector body and the die for forming the terminals must be accordingly redesigned. This derives a high production cost.

Thus, an adapter is needed to increase the height of an electrical connector without the necessity to manufacturing electrical connectors in different heights.

BRIEF SUMMARY OF THE INVENTION

A main object of the present invention is to provide an electrical connector having an adapter for increasing the height of the electrical connector to meet a different application requirement, thereby reducing the production cost of manufacturing different electrical connectors.

To fulfill the above-mentioned object, an electrical connector in accordance with the present invention comprises a connector body retaining a plurality of terminals and an adapter retaining a like number of connecting contacts. Each terminal includes a contacting portions extending beyond a bottom surface of the connector body for engaging with corresponding connecting contacts of the adapter. Each connecting contact includes a main body to be received within the base, a tail portion extending downwards from the main body for electrically connecting to the circuit board and a first portion and a second portion extending sidewards and upwards from the main body. The second portion, therefore, is laterally offset from the first portion. Both the first and second portions have, respectively, opposed first and second barbs extending inward from a side edge for clamping a contacting portion of corresponding terminal therebetween. Each contacting portion further defines a notch in a side edge thereof for engaging with the first barb of corresponding connecting contact.

Other objects, advantages and novel features of the invention will become more apparent from the following detailed description when taken in conjunction with the accompanying drawings.

DETAILED DESCRIPTION OF THE INVENTION

Figure 1:
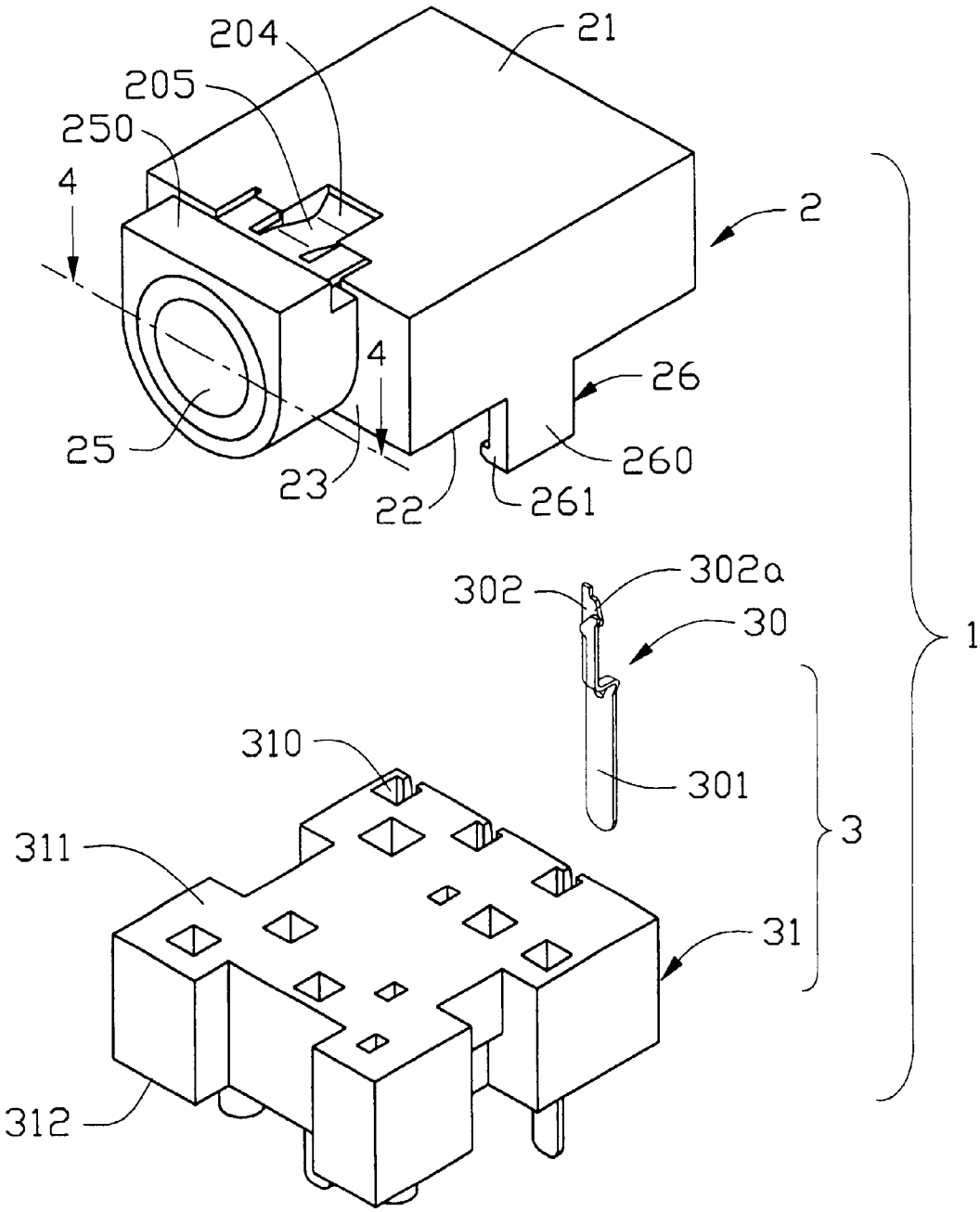
FIG. 1 is an exploded view of an electrical connector with an adapter in accordance with the present invention.
Figure 3:
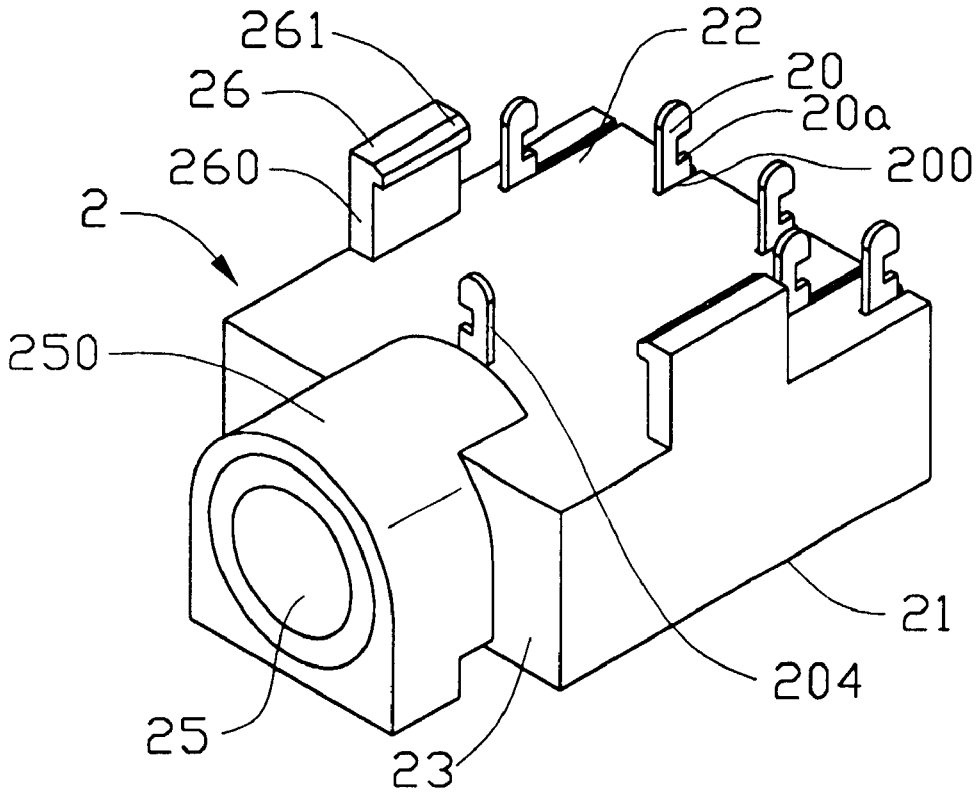
FIG. 3 is a perspective view of a bottom side of a connector body of the electrical connector.
Figure 6:
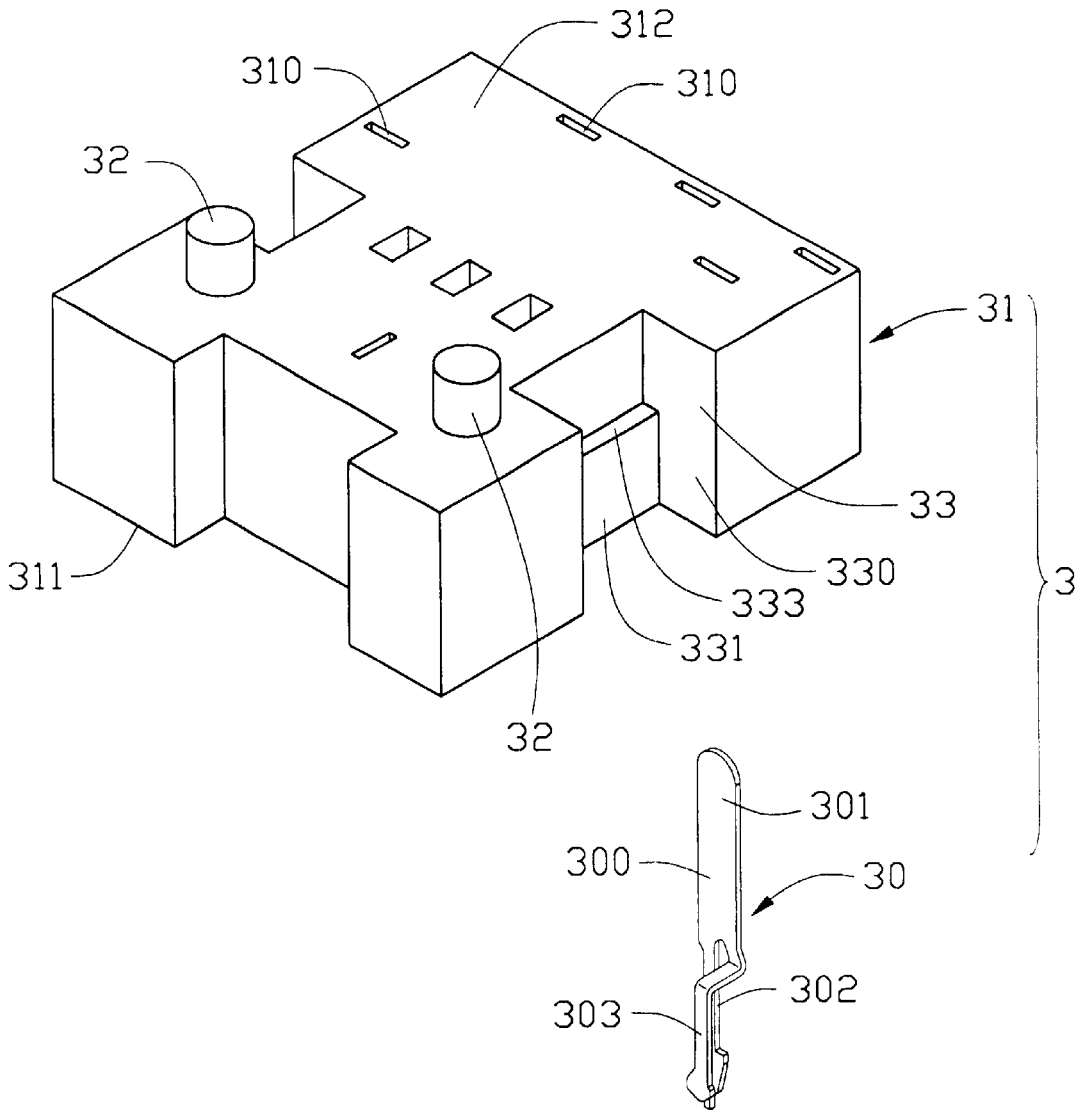
FIG. 6 is a perspective view of a bottom side of the adapter and the connecting contact.

Referring to FIGS. 1, 3, and 6, an electrical connector 1 in accordance with the present invention comprises a connector body 2 retaining six terminals 20 therein and an adapter 3 comprising a base 31 and six connecting contacts 30 received therein.

Figure 4:
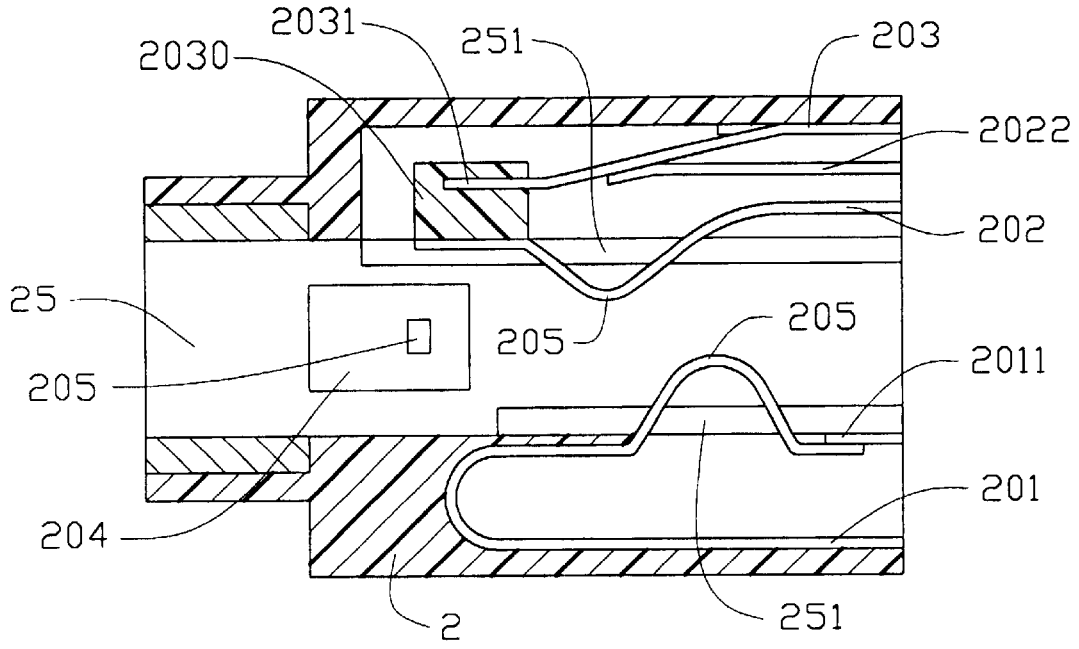
FIG. 4 is a cross-sectional view taken along line 4—4 of FIG. 1.
Figure 5:
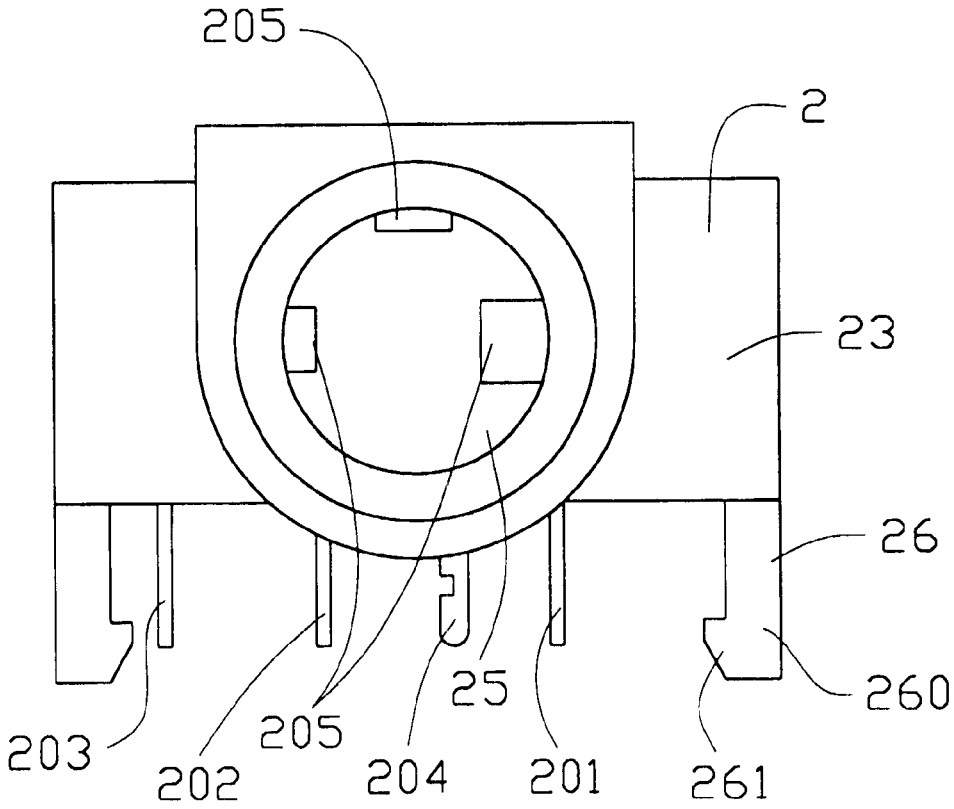
FIG. 5 is a front view of the connector body.

The connector body 2 comprises a top surface 21 and a bottom surface 22. Six passageways 200 are defined in a non-symmetric pattern in the bottom surface 22 for receiving corresponding terminals 20 therein. The terminals 20 extend beyond the bottom surface 22 of the connector body 2 for inserting in corresponding receiving holes 310 of the adapter 3. A projection portion 250 is formed on a front surface 23 of the connector body 2 for engaging with a plug (not shown) for audio transmission. A tubular receptacle 25 is defined through the connector body 2. Referring to FIGS. 4 and 5, a pair of receiving portions 251 is defined in the connector body 2 to either side thereof and in communication with the receptacle 25 for receiving the corresponding terminals 20 to electrically contact the inserted plug. A pair of locking elements 26 is formed at lateral edges of the bottom surface of the connector body 2. Each locking element 26 comprises a locking arm 260 and a locking tip 261.

The terminals 20 comprise a first, second, and third movable terminal 201, 202, 203, and a first, second, and third fixing terminal 2011, 2022, 204. An engaging portion (not labeled) of each terminal 201, 202, 203, 204, 2011, 2022 is received in the connector body 2, and a contacting portion (not labeled) extends beyond the bottom surface 22 for electrically contacting with the corresponding connecting contacts 30 of the adapter 3. Each contacting portion (not labeled) defines a notch 20a in a side edge thereof. The first and second movable terminals 201, 202 and the third fixing terminal 204 each has a resilient portion forming a contacting arm 205. An end portion 2031 of the third movable terminal 203 is secured within an insulative block 2030.

Before the electrical connector 1 engages with a plug, the first movable terminal 201 electrically contacts the first fixing terminal 2011, and the second fixing terminal 2022 contacts the third movable terminal 203. The second movable terminal 202 connects with the insulative block 2030. After the electrical connector 1 engages with the plug, the contacting arms 205 of the first and second movable terminals 201, 202 and the third fixing terminal 204 electrically contact corresponding parts of the plug. Insertion of the plug causes the first movable terminal 201 to separate from the first fixing terminal 2011, and the insulative block 2030 to move outward, causing the third movable terminal 203 separate from the second fixing terminal 2022, whereby electrical signals are transmitted between the plug and the electrical connector 1. Because the most structures of the connector body 2 have been introduced in prior art, it is not detailed described here.

Referring to FIGS. 1 and 6, the base 31 of the adapter 3 comprises a top surface 311 and a bottom surface 312. Six receiving holes 310 are defined through the adapter 3 for retaining the connecting contacts 30. A pair of posts 32 extends from the bottom surface 312 for securely positioning the base 31 on a printed circuit board (not shown). A pair of locking portions 33 is defined in opposite lateral faces of the base 31. Each locking portion 33 comprises a recess 330 and a locking block 331 extending into an upper portion of the recess 330.

Figure 2:
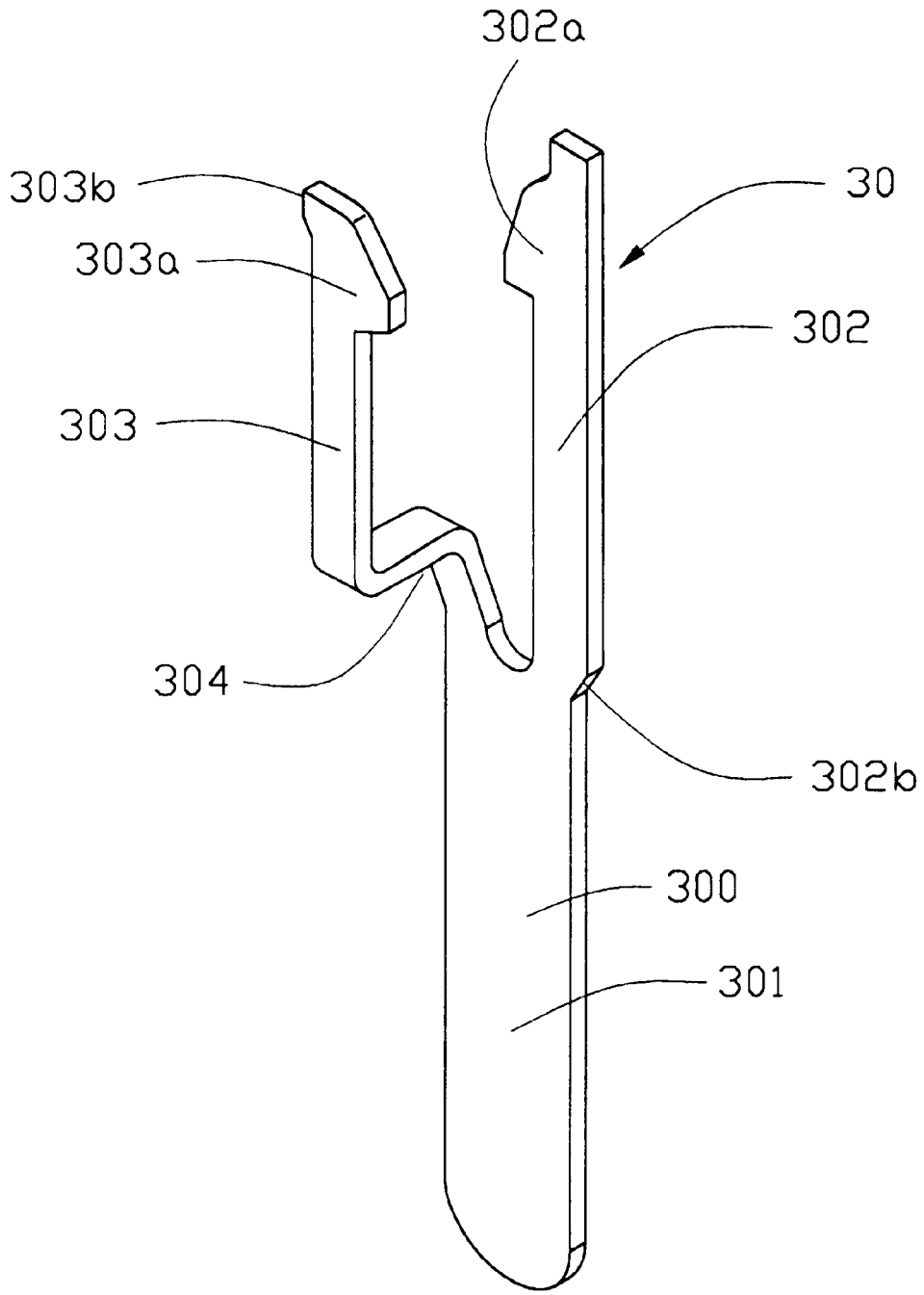
FIG. 2 is an enlarged view of a connecting contact of FIG. 1.

Referring to FIGS. 2 and 3, the connecting contacts 30 are formed by stamping a metal plate. Each connecting contact 30 includes a main body 300 to be secured within the receiving holes 310 of the base 31, a tail portion 301 extending downwards from the main body 300 for electrically connecting to the printed circuit board and a first portion 302 and a second portion 303 both extending from an upper edge of the main body 300. The first portion 302 includes a first barb 302*a* for abutting the contacting portion (not labeled) of a corresponding terminal 201, 202, 203, 204, 2011 or 2022, and a slant face 302*b* for holding pressure against the side wall of the corresponding receiving hole 310. The second portion 303 is offset from the first portion 302 through an extending portion 304. This second portion 303 comprises a second barb 303*a* arranged opposite to the first barb 302*a* for contacting with the contacting portion of a corresponding terminal 201, 202, 203, 204, 2011 or 2022, and a protrusion 303*b* extending from an outer edge of the second barb 303*a* for engaging with the side wall of the corresponding receiving holes 310.

Figure 7:
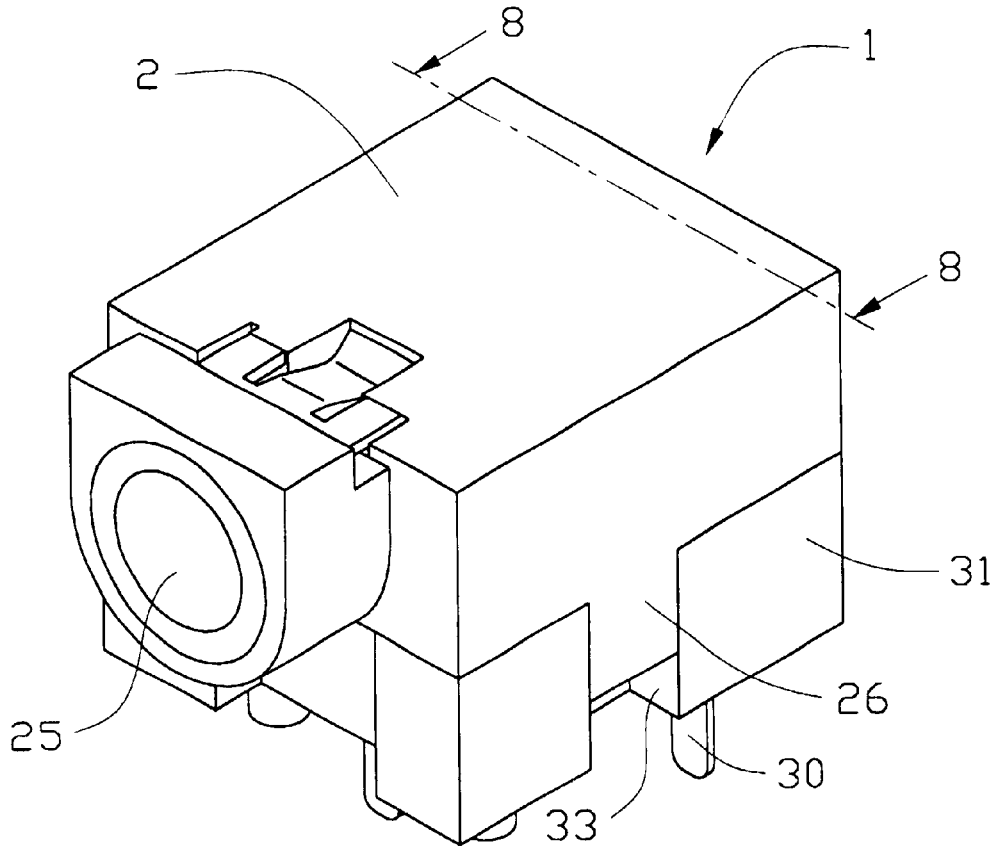
FIG. 7 is a perspective view of the assembled electrical connector.
Figure 8:
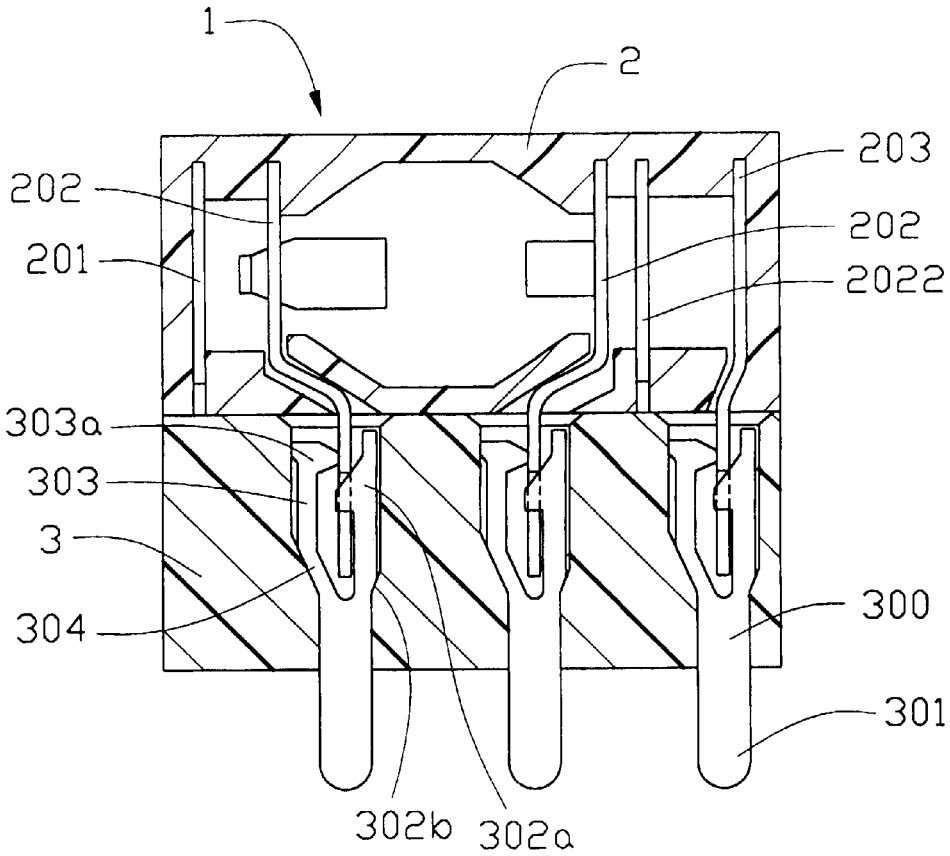
FIG. 8 is a cross-sectional view taken along line 8—8 of FIG. 7.

Referring to FIGS. 7 and 8, in assembly the terminals 20 are respectively received in the corresponding passageways 200 of the connector body 2, the contacting portions (not labeled) of the terminals 20 extending out of the bottom surface 22 of the connector body 2. The connecting contacts 30 are received in the corresponding receiving holes 310 of the base 31. The connector body 2 is then mated with the adapter 3, each locking arm 260 being received in a corresponding recess 330 and engaging with a corresponding block 331 by having the locking tip 261 of the locking arm 260 abut against a bottom face 331 (FIG. 6) of the block 331. During mating of the connector body 2 with the adapter 3, the contacting portion of each terminal 201, 202, 203, 204, 2011 and 2022 is snugly received between the first portion 302 and the second portion 303 of each connecting contact 30 with the first barb 302a securely engaging within the notch 20*a* of the corresponding terminal 20 and an inner edge of the second barb 303*b* engaging a portion of the contacting portion of the terminal 20 above the notch 20*a,* thereby establishing a reliable electrical and mechanical connection between the terminals 20 and the connecting contacts 201, 202, 203, 204, 2011 and 2022. The extending portion 304 holds pressure against the sidewall (not labeled) of the corresponding receiving hole 310. The protrusion 303*b* interferentially engages with a corresponding side wall of a receiving hole 310, and the slant face 302*b* of the first portion 302 holds pressure against an opposite corresponding side wall of the receiving holes 310. The adapter 3 can be suitably formed to provide the electrical connector 1 with a required height. Thus, manufacturing cost is reduced by eliminating the necessity of manufacturing electrical connectors in different heights.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly with an adapter for increasing an overall height of the connector above a printed circuit board comprising:

a connector body defining a plurality of passageways therein;

a plurality of terminals being received in corresponding passageways of the connector body, each terminal having an engaging portion received in the connector body and a contacting portion extending beyond a bottom surface of the connector body; and an adapter consisting of:

a base secured below the connector body, the base defining a plurality of receiving holes; and a plurality of connecting contacts secured in corresponding receiving holes of the adapter, each connecting contact having a main body to be received in the corresponding receiving hole of the base, a tail portion adapted to be connected to the printed circuit board, a first portion extending upwardly from the main body and having a first barb for latching to the contacting portion of the corresponding terminal;

wherein a second portion also extends upwardly from the main body and is spaced from the first portion and has a second barb for contacting the corresponding contacting portion of the terminal;

wherein the contacting portion of the terminal defines a notch in one edge thereof for securely engaging with the first barb of the first portion;

wherein the second portion of each connecting contact is offset from the first portion for securing and contacting with the contacting portion of the corresponding terminal;

wherein the base defines a pair of locking portions in opposite lateral faces thereof, the connector body forms a pair of locking elements at lateral edges of the bottom surface thereof to be received in the locking portions;

wherein the locking portions comprise a recess and a locking block extending into an upper portion of the recess, the locking elements comprise a locking arm and a locking tip, whereby when the connector is mated on the base, each locking arm is received in a corresponding recess and engages with a corresponding block by having the locking tip of the locking arm abut against a bottom face of the block.

* * * * *